United States Patent [19]

Olsson

[11] Patent Number: 4,891,019

[45] Date of Patent: Jan. 2, 1990

[54] ELECTRICAL CONNECTOR FOR INTERCONNECTING A PRINTED CIRCUIT BOARD TO A RIBBON CABLE

[75] Inventor: Billy E. Olsson, New Cumberland, Pa.

[73] Assignee: AMP Incorporated, Harrisburg, Pa.

[21] Appl. No.: 318,780

[22] Filed: Mar. 3, 1989

[51] Int. Cl.[4] ..... H01R 4/24

[52] U.S. Cl. ..... 439/404

[58] Field of Search ..... 439/389–426

[56] References Cited

U.S. PATENT DOCUMENTS

| | | | |
|---|---|---|---|
| 3,697,926 | 10/1972 | Krafthefer | 339/17 |
| 3,706,954 | 12/1972 | Krafthefer | 339/17 L |
| 4,093,330 | 6/1978 | Pittman | 339/17 |
| 4,268,102 | 5/1981 | Grabbe | 339/75 |
| 4,354,729 | 10/1982 | Grabbe | 339/258 |
| 4,395,084 | 7/1983 | Conrad | 339/75 |
| 4,571,015 | 2/1986 | Mueller | 339/17 |
| 4,647,124 | 3/1987 | Kandybowski | 339/17 |
| 4,653,831 | 3/1987 | Wilson et al. | 439/404 |
| 4,693,533 | 9/1987 | Szczesny et al. | 439/404 |
| 4,699,593 | 10/1987 | Grabbe et al. | 439/71 |

*Primary Examiner*—Joseph H. McGlynn

*Attorney, Agent, or Firm*—Bruce J. Wolstoncroft

[57] ABSTRACT

An electrical connector (2) has a series of terminals (14) which extend from a first surface (78) to a second surface (60). The terminals (14) have a cable terminating sections (16) provided proximate the first surface (78), and board engagement sections (20) provided proximate the second surface (60). Transition sections are provided between the cable terminating sections (16) and the board terminating sections (20). The transition sections are provided to compensate for the different centerline spacing of sections (16, 20). The transition sections have shoulders (26) provided thereon, the shoulders (26) cooperate with retention surfaces (68) of the connector (2) to insure that the terminals (14) are maintained in accurate alignment.

14 Claims, 6 Drawing Sheets

ELECTRICAL CONNECTOR FOR INTERCONNECTING A PRINTED CIRCUIT BOARD TO A RIBBON CABLE

SUMMARY OF THE INVENTION

The invention is directed to an electrical connector which provides an electrical connection between a printed circuit board and an electrical cable. In particular, the connector has terminals which are supported by and extend through the housing of the connector, in such a manner so as to eliminate the need for mounting hardware.

BACKGROUND OF THE INVENTION

As a result of the increasing complexity associated with the electronic assembly and computer arts, the demand for more sophisticated and reliable connectors has increased. Smaller size, lighter weight packaging and an augmented necessity for reliability have virtually rendered obsolete individually soldered connectors in many areas of the industry.

Consequently, numerous electrical connectors have been manufactured which have eliminated the need to solder the terminals to the conductive areas of the electrical component. Many of these electrical connectors are commonly used to electrically connect two printed circuit boards together, or they are used to electrically connect a chip carrier to a printed circuit board. While many of these connectors have terminals which are cammed into electrical engagement with the respective conductive areas of the electrical component, other connectors utilize compressive technology to insure that a positive electrical connection has been effected.

Compressive connectors can be in many forms depending upon the characteristics required for termination. One well known type of compressive connector is manufactured from elastomeric material. However, other type of compressive connectors have stamped and formed terminals provided therein. The terminals have the resilient characteristics required to insure that the terminals will resiliently deform as the electrical component is moved into place. An example of this type of compressive electrical connector is illustrate in U.S. Pat. No. 4,699,593.

As shown in the above referenced patent, the compressive connectors are generally utilized to interconnect electrical components which have conductive areas provided thereon. However, there are many instances in which it is required to electrically connect a ribbon cable to a printed circuit board or the like. In order to accomplish this interconnection, without the use of solder, it is essential that the electrical connector utilize a compressive technology to make the electrical connection with the conductive areas of the printed circuit board. It is also essential to insure that the electrical connector is placed in effective electrical connection with the ribbon cable. Consequently, the termination of the ribbon cable must be accomplished through the use of an insulation displacement means or the like.

In order to effectively utilize an electrical connector which has terminals with compressive technology at one end, and displacement technology at the opposed end, it is essential that the terminals be accurately maintained in the housing of the connector. This task is made more difficult due to the forces associated with the termination of the terminals onto the ribbon cable.

It would, therefore, be beneficial to provide an electrical connector which was able to provide the electrical connection required between a ribbon cable and a printed circuit board or the like. The electrical connector would have the means to cooperate with the terminals to insure that the ends of the terminals which utilized the compressive technology would not be moved when the ribbon cable was terminated to the opposed ends of the terminals.

SUMMARY OF THE INVENTION

The invention is directed to an electrical connector for use to electrically connect conductors of ribbon cables to conductive areas of a printed circuit board, the electrical connector has a housing means which has terminal receiving cavities extending therethrough. Terminals are provided in the terminal receiving cavities, the terminals have cable termination sections provided at respective ends thereof and board termination sections provided at the opposite ends. The cable termination sections and the board termination sections have different centerline spacing.

Transition sections are provided on the terminals. The transition sections have shoulder means which cooperate with the housing means to maintain the terminals in position, and to distribute the forces associated with the terminals to the housing means.

In another aspect of the invention, the terminals have intermediate portions which have first ends and second ends. The cable termination sections extend from the first ends of the intermediate portions, and have slots provided therein. The slots cooperate with respective conductors of the ribbon cable when the conductors are inserted into the slots, such that the slots displace the insulation of the conductors to place the conductors in electrical engagement with the terminals.

The board termination sections extend from second ends of the intermediate portions. The board termination sections have board engagement areas provided thereon, such that as the board is moved into engagement with the board engagement areas, the resilient characteristics of the board mounting sections will maintain the board engagement areas in electrical engagement with the conductive areas of the printed circuit board.

DETAILED DESCRIPTION OF THE INVENTION

Figure 1:
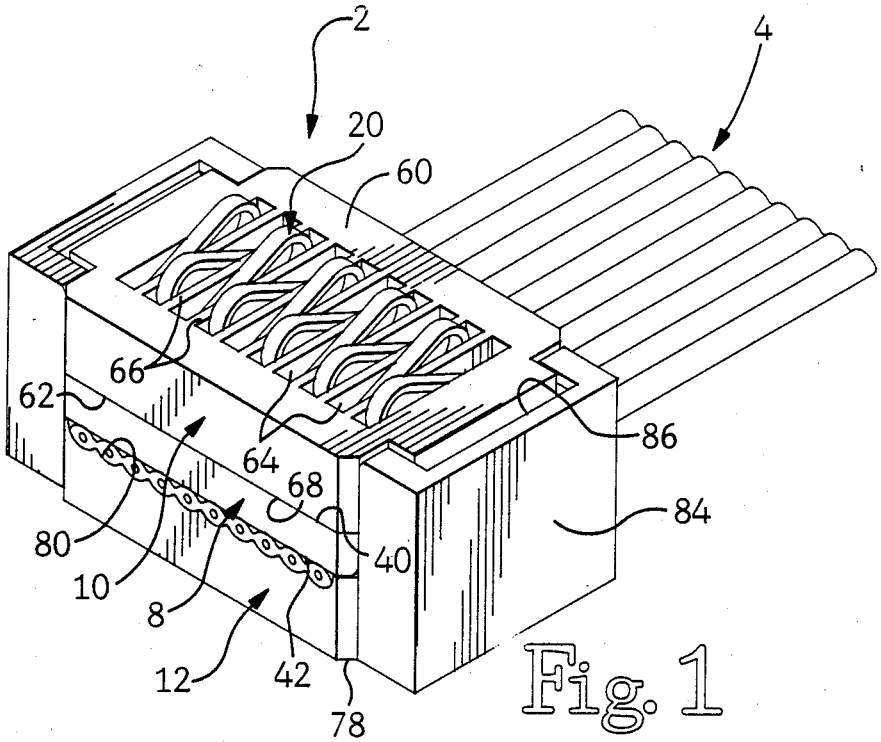
FIG. 1 is a perspective view of an electrical connector of the present invention, the connector being shown in the fully assembled position, with a ribbon cable terminated therein.

An electrical connector 2 is provided to electrically interconnect a flat ribbon cable 4 to a printed circuit board 6. The electrical connector 2 has a housing block 8, a guide block 10, and a cover 12. Terminals 14 extend through the connector to provide the electrical pathway between the flat ribbon cable 4 and the printed circuit board 6.

Figure 6:
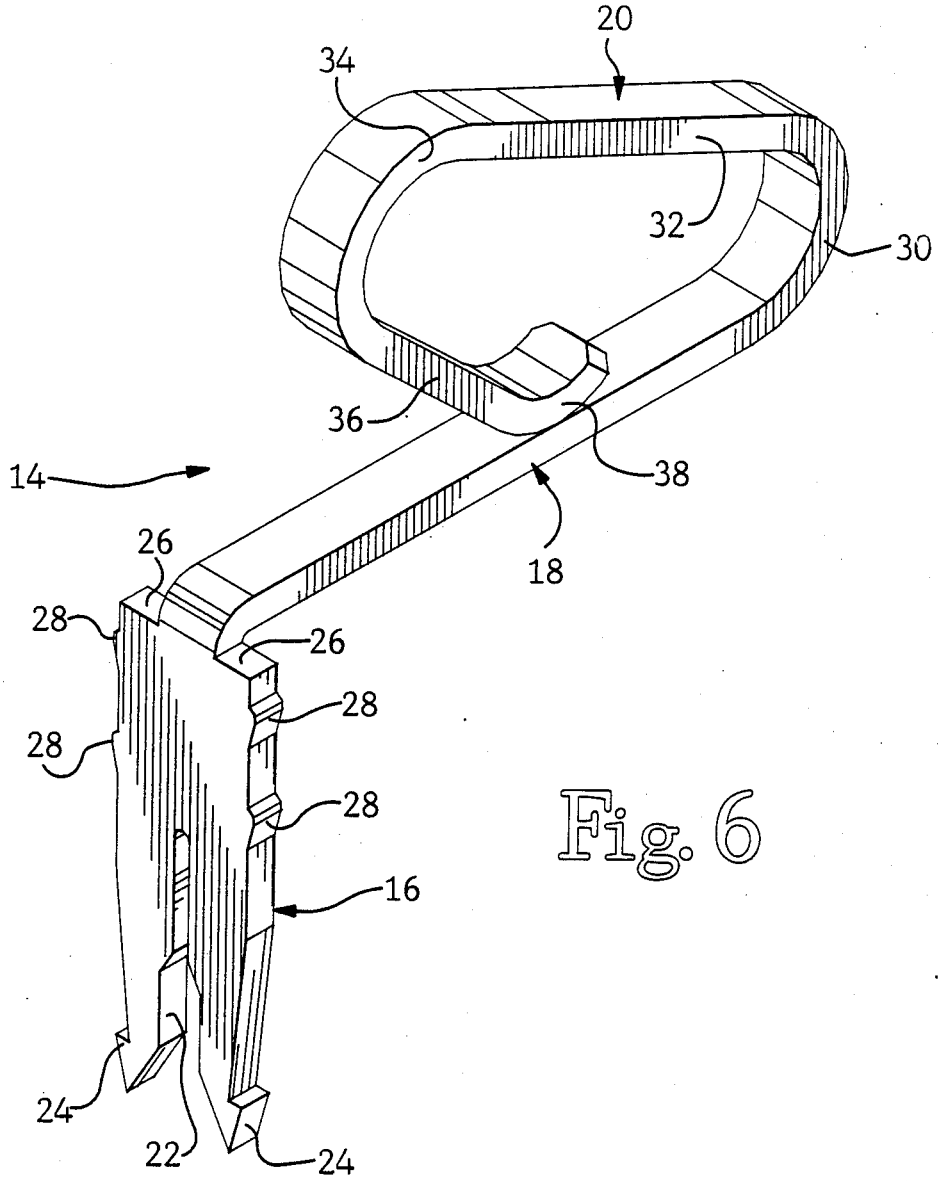
FIG. 6 is a perspective view of a respective terminal which is provided in the connector.

As best shown in FIG. 6, each terminal 14 has a cable terminating section 16, an intermediate section 18, and a board engagement section 20. The cable terminating sections 16 have insulation displacement slots 22 provided at ends thereof. The insulation displacement slots 22 are of the type commonly used in the industry to displace the insulation from the cable to insure that a proper electrical connection is effected between the conductors of the cable and the terminals. Barbs 24 are provided proximate the slots 22 of the terminals 14. The barbs 24 cooperate with the cover 12 to maintain the cover in position relative to the housing block 8. As the operation of insulation displacement slots are well known, a further explanation is not deemed necessary.

Shoulders 26 are provided at the end of the cable terminating sections 16 which are opposite barbs 24. Protrusions 28 extend from side edges of the cable terminating sections 16. In the particular embodiment shown, two protrusions 28 extend from each side surface of the terminals 14.

Figure 3:
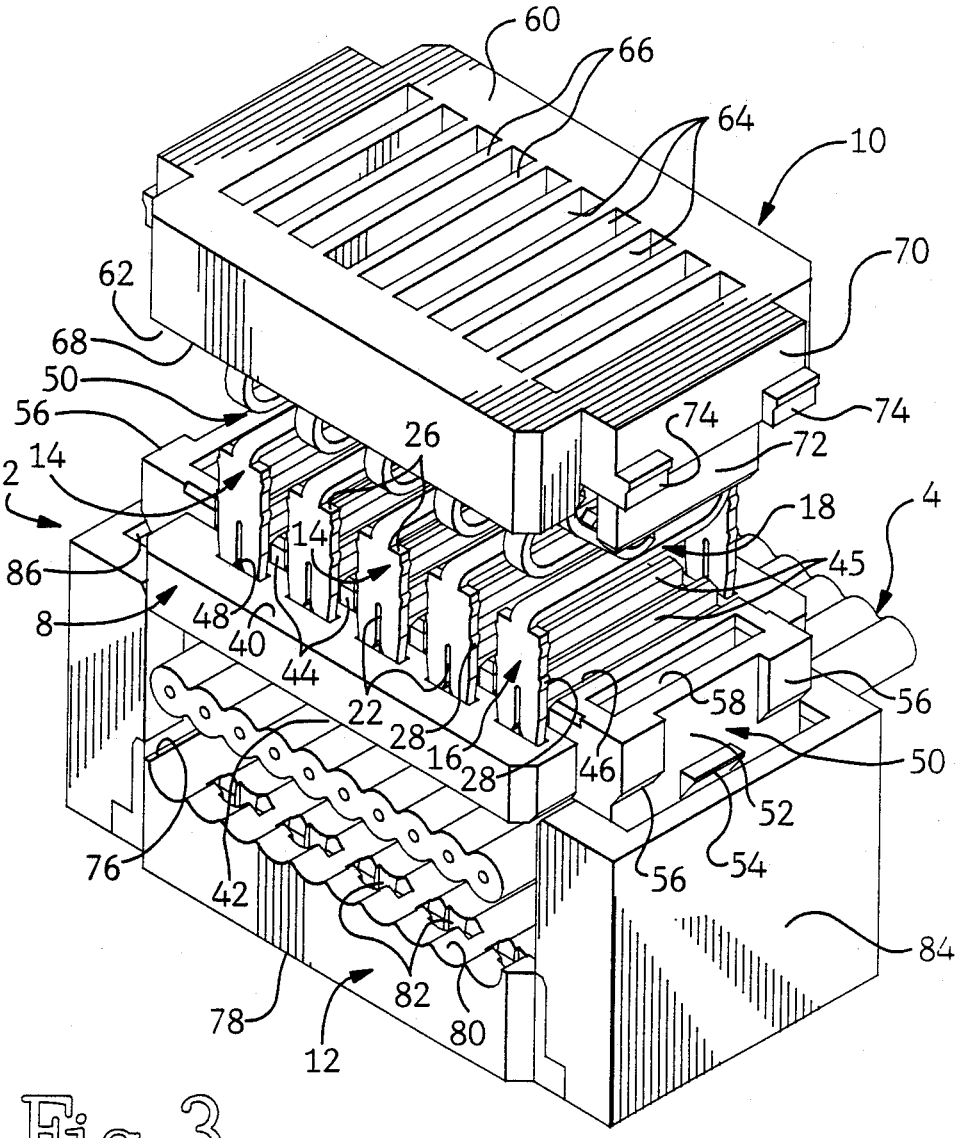
FIG. 3 is a perspective view of the electrical connector, showing the various components exploded from each other.

Intermediate sections 18 extend from the cable terminating sections 16, in a direction which is essentially perpendicular to the cable terminating sections. As is shown in FIGS. 3 and 6, the intermediate sections 18 have a width which is essentially one half the width of the cable terminating sections 16. This allows the cable terminating sections 18 to cooperate with ribbon cable having a greater centerline spacing than that of the conductive pads on the circuit board 6. It should be noted that the shoulders 26 act as the transition sections between the intermediate sections 18 and the cable terminating sections 16.

The board engagement sections 20 extend from the intermediate sections 18, as is best shown in FIG. 6. The intermediate sections 18 include arcuate first juncture portions 30 which curve upwardly and rearwardly. The juncture portions 30 merge with first or contact making legs 32 which are positioned at an arcuate angle with respect to the intermediate sections 18, and the legs 32 merge with a reversely curved second juncture portions 34. The juncture portions 34 merge with second legs 36. The second legs terminate in lips 38, the lips being slidable on surfaces of the intermediate sections 18. Thus, the legs 32, 36 and the parts 30, 34, 38 and portions of the intermediate sections 18 cooperate to form a loop which is generally oval-shaped and which is capable of a modicum of flattening. A further explanation of the board engagement sections 20 of the terminal is provided in U.S. Pat. No. 3,697,926, which is hereby incorporated by reference.

Figure 5:
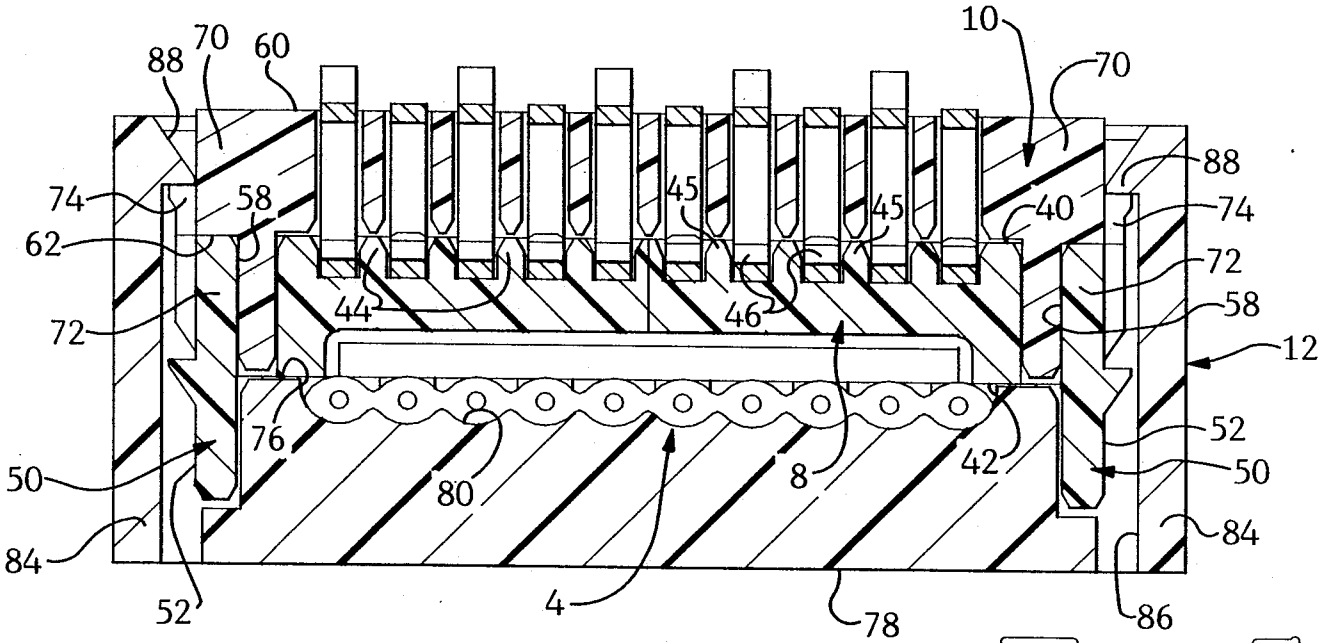
FIG. 5 is a cross-section view of the connector showing the position of the latch means when the connector is in the fully assembled position.

Housing block 8 has a first major surface 40 and an oppositely facing second major surface 42. As is best shown in FIG. 3, dividing walls 44 extend from the first major surface 40 of housing block 8 in a direction away from the second major surface 42. The dividing walls 44 are essentially perpendicular to the plane of the first major surface. It should be noted that the dividing walls 44 extend from proximate a side surface of the housing block 8 to proximate an oppositely facing side surface of the block 8. As best shown in FIG. 5, each dividing projection has a tapered free end portion 45, which enables for the insertion of the intermediate portions 18 of the terminals therebetween.

Each respective pair of dividing walls 44 has a terminal receiving recess 46 provided therebetween. Referring back to FIG. 3, openings 48 are provided in alignment with the terminal receiving recesses. The openings 48 extend from the first major surface 40 of the housing block to the second major surface 42. It is important to note, that in the embodiment shown, the terminal receiving recesses 46 have a centerline spacing which is essentially half the centerline spacing as the openings 48. Consequently, in order for the terminals to be inserted into the housing block 8, the openings 48 must be staggered with respect to the recesses 46. In other words, the openings 48 on the right side of the housing block will be provided in alignment with the even terminal receiving recesses, and the openings on the left side of the housing block will be provided in alignment with the odd terminal receiving recesses.

As is shown in FIGS. 3 and 5, housing block 8 has latching arms 50 which extend from either end of the housing block. Outside surfaces 52 of latching arms 50 have projections 54, 56 extending therefrom. Openings 58 are provided in the latching arms 50 proximate the outside surfaces 52. The openings 58 have side walls which are essentially parallel to the outside surfaces 52 of latching arms, as is best shown in FIG. 5.

Figure 4:
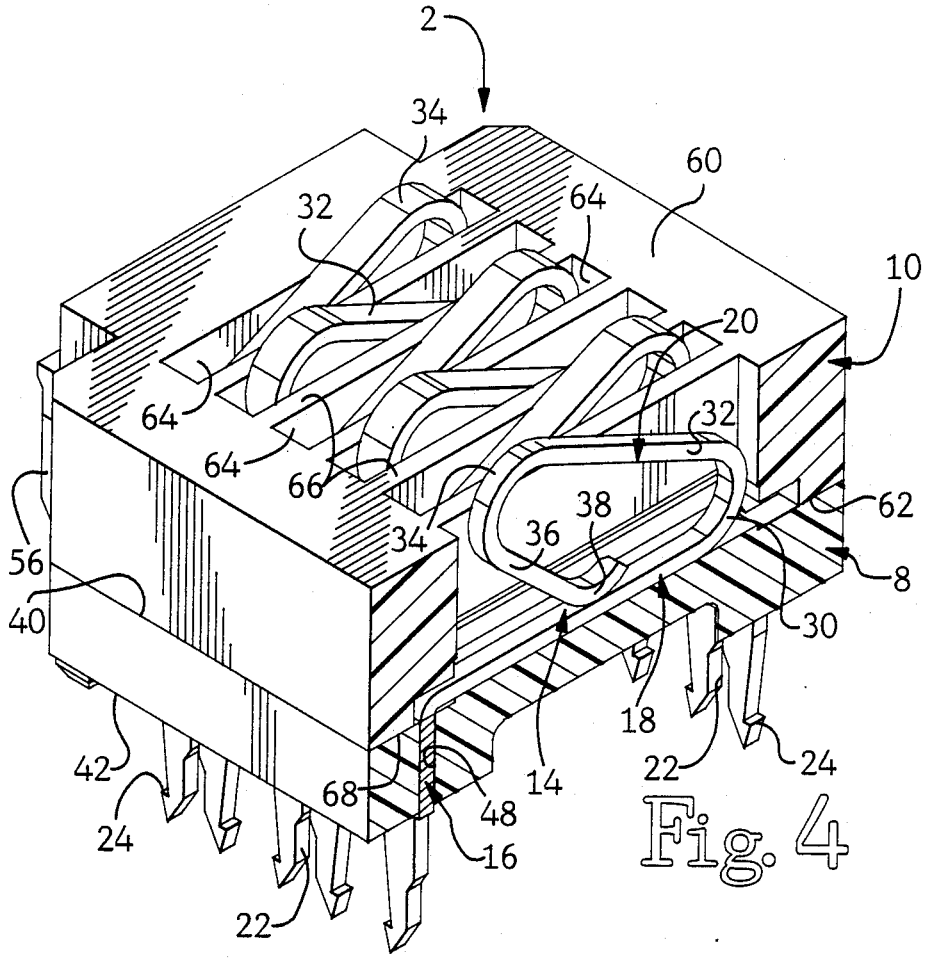
FIG. 4 is a sectional view of the connector showing a respective terminal extending through the housing of the connector.

Guide block 10, as best shown in FIGS. 3 and 4, has an upper surface 60 and a lower surface 62. Cavities 64 are provided in the guide block 10 and extend from the upper surface to the lower surface. The cavities are dimensioned to receive the board engagement sections 20 of the terminals 14, as will be more fully discussed. Separation walls 66 are provided between the cavities 64, the walls 66 insure, that the terminals 14 will not electrically engage each other during the operation of the connector. As is best shown in FIG. 3, the walls 66 lie in a plane which is essentially perpendicular to the plane of the side surfaces of guide block 10. It is to be noted that cavities 64 and walls 66 do not extend to the side surfaces of the guide block 10, but rather flat retention surfaces 68 are provided proximate the side surfaces of the guide block.

Latch members 70 extend from each end surface of the guide block 10. As is shown in FIGS. 3 and 5, latch members 70 have rectangular ribs 72 which extend downward beyond lower surface 62. Ribs 72 are dimensioned to allow the ribs to be inserted into openings 58 of housing block 8. Projections 74 also extend from latch members 70. The projections 74 are provided on the outside surface of latch member, as is shown in FIG. 3.

Figure 2:
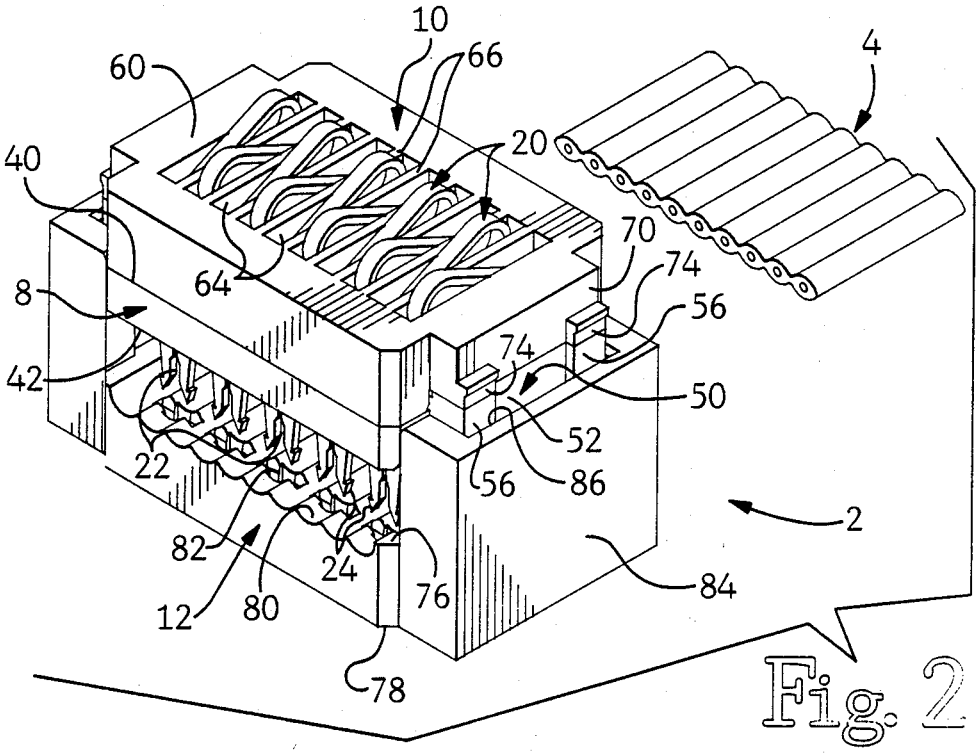
FIG. 2 is a perspective view of the electrical connector showing the connector in a preassembled position, prior to the insertion of the ribbon cable therein.

Cover 12, as best shown in FIGS. 2 and 5, has a first surface 76 and a second surface 78. Concave recesses 80 are provided on the first surface 76. Contact receiving openings 82 are provided in the cover 12. The openings 82 extend from the first surface 76 to the second surface 78, and are provided in alignment with openings 48 of housing block 8. Latch covers 84 are provided on the end surface of the cover 12, and extend from the second surface to beyond the first surface. As shown in FIG. 5, latch covers 84 have an opening 86 which extends therethrough. A triangular projection 88 extends into the opening 86 from a side wall of the opening. The opening is dimensioned to allow the latching arms 50 and latch members 70 to be inserted therein.

During the assembly of the connector, housing block 8 cooperates with terminals 14 to maintain the terminals in position relative to the housing block. As is shown in FIG. 3, cable terminating sections 16 are inserted into the openings 48 of housing block 8. The position of the terminals shown in FIG. 3 depicts the terminals in a partially inserted position. The fully inserted position of the terminals 14 in the housing block 8 is better illustrated in FIG. 4.

In the fully inserted position, the intermediate sections 18 are provided in the recesses 46 of the housing block 8. The positioning of the intermediate sections in the recesses prevents the terminals from making electrical engagement with each other, thereby preventing the shorting of the connector. The frictional engagement between the protrusions 28 and the sidewalls of the openings 48 provides a sufficient force to maintain the terminals in the openings while the connector is being assembled. As is shown in the figures, when the terminals are fully inserted into the housing block, the insulation displacement slots 22 extend from proximate the second major surface 42 of the housing block in a direction which is opposed to the first major surface 40.

It is important to note that when the terminals are in the fully inserted position, the shoulders 26 of the cable terminating sections 16 are coplanar with the first major surface 40 of the housing block 8. It is also important to note, that due to the configuration of the dividing walls 44 and the openings 48, cable terminating sections can be spaced at centerlines of 0.100 of an inch, while the board engagement sections can be provided at a centerline spacing of 0.050 inches.

With the terminals 14 properly positioned in relation to the housing block 8, guide block 10 is positioned over the housing block. Guide block 10 is moved toward housing block 8 so that after the guide block is fully inserted onto the housing block, the first major surface 40 of the housing block 8 will be in engagement with the lower surface 62 of the guide block 8.

As the insertion of the guide block onto the housing block occurs, it is important to note that the alignment of the guide block must be accurately controlled. In order to insure that the alignment is correct, rectangular ribs 72 of latch members 70 of guide block 10 cooperate with openings 58 of the housing block 8. Respective dimensions of the openings are slightly larger than the corresponding dimensions of the ribs 72, while other dimensions of the openings are essentially equal to the respective dimensions of the ribs. Consequently, the ribs 72 may be inserted into the openings 58 with minimal force. However, the ribs 72 are precisely maintained in the openings 58, and therefore, the guide block is accurately maintained in position relative to the housing block 8.

During insertion of the guide block, the board engagement sections 20 of the terminals 14 are positioned in the cavities 64 of the guide block 8. This insures that the terminals will be separated from each other by the walls 66 provided between the cavities. It should be noted that upon complete insertion of the guide block onto the housing block, separation walls 66 form an extension of dividing walls 44 of the housing block 8.

The frictional engagement between the ribs 72 and the openings 58 insures that the guide block 10 will be maintained in position relative to housing block 8, until the guide block is locked in position.

As was previously stated, when the terminals are in the fully inserted position, the shoulders 26 of the cable terminating sections 16 are coplanar with the first major surface 40 of the housing block 8. When the guide block is fully inserted onto the housing block, the flat retention surfaces 68 of the lower surface 62 of guide block are placed in engagement with the first major surface 40 of the housing block 8. The lower surface 62 is thereby positioned over the shoulders 26 of the terminals 14. This is an important feature of the invention, because it provides the support necessary for the terminals. As the cable terminating sections 16 of the terminals engage the cable 4, considerable forces are transmitted through the cable. It is important that these forces be dissipated to the housing to prevent the terminals from backing out of the connector. This is particularly important to insure that the board terminating sections 20 are maintained in precise alignment as the cable terminating sections 16 are terminated to the cable. Consequently, the cooperation of the shoulders 26 with the guide block 8 insures that as the forces are applied to the cable terminating sections 16, the force will be transmitted through the shoulders to the guide block. This cooperation of the shoulders with the lower surface acts as a positive retention means which prevents the movement of the terminals relative to the connector.

It is also important to note that when the guide block 10 is fully inserted onto the housing block 8, portions of the board engagement sections 20 extend from cavities 64 to beyond the upper surface 60. This allows the terminals to be placed in electrical engagement with the printed circuit board.

With the guide block fully inserted onto the housing block and maintained in position by the frictional engagement of the ribs 72 with the endwalls of the openings 58, the cover 12 is brought into engagement with the housing and guide block subassembly. As is shown in FIGS. 1 and 2, the cover cooperates with the subassembly to provide a preassembled position and a fully inserted position.

In the preassembled position, latching arms 50 are positioned in openings 86 of latch covers 84. The dimensioning of the latch arms and the openings insures that the cover 12 will be accurately maintained in position relative to the housing, guide block subassembly. In this preassembled position, projections 88 are provided in cooperation with projections 54 to prevent the cover from being removed from the subassembly. In this preassembled position, as shown in FIG. 2, a space is provided between second major surface 42 of the housing block 8 and the first surface 72 of the cover 12. This allows the cable to be inserted therebetween.

With the cable inserted between the housing block 8 and the cover 12, the cover is moved toward the housing block. This movement causes projections 88 to move along projections 56. Movement is continued until projections 88 engage projections 74, as shown in FIG. 5. In this fully assembled position, as shown in FIGS. 1 and 5, the cable 4 is trapped between the housing block and the cover, thereby insuring that the cable terminating sections 16 of the terminals have pierced the insulation surrounding the conductors of the cable. In this fully assembled position, housing block 8, guide block 10 and cover 12 are securely and positively retained in position relative to each other.

Figure 7:
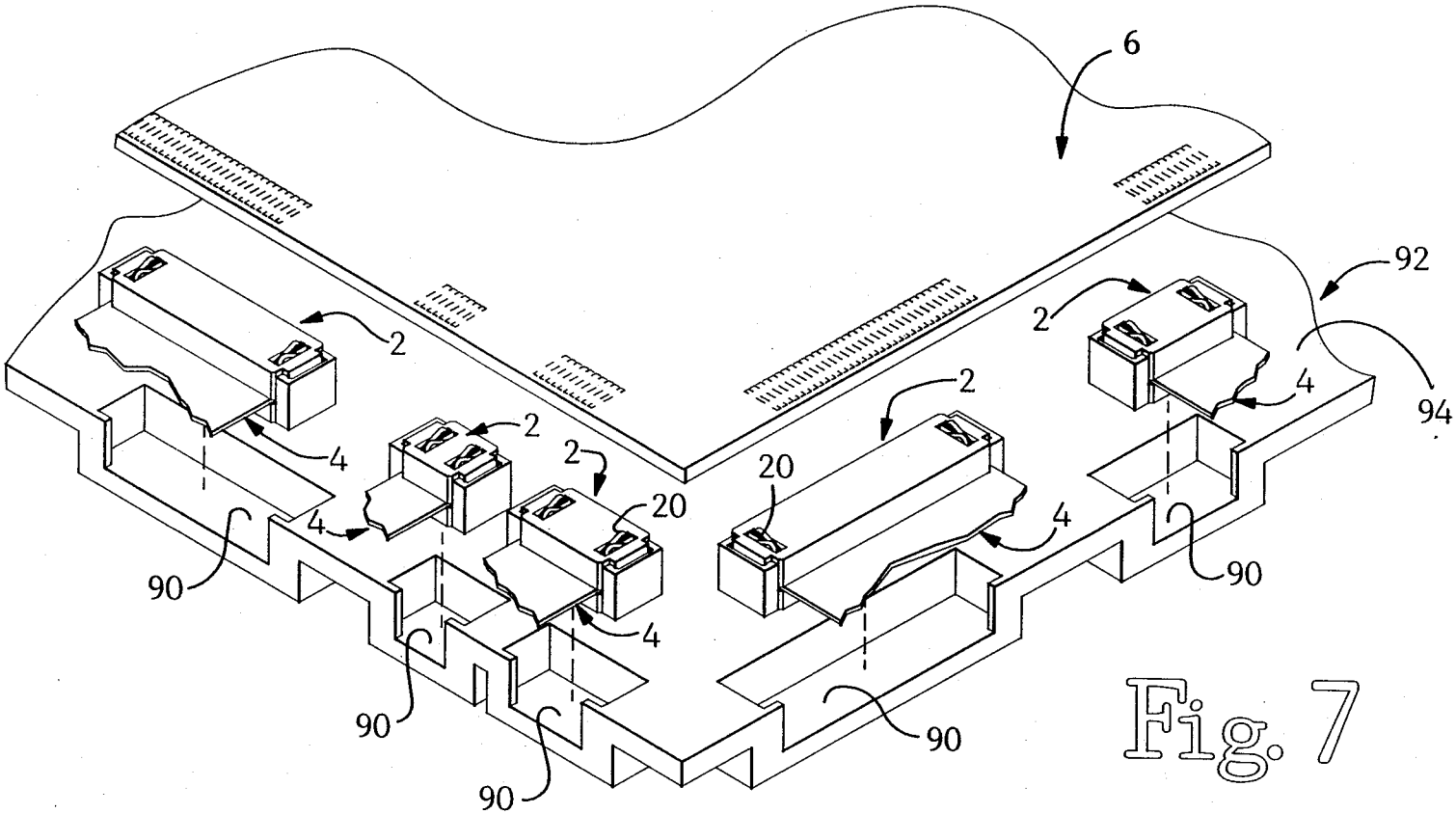
FIG. 7 is a partial exploded view of a system in which the electrical connector is used, the connectors shown are in the assembled position.

A representative system in which the above described connectors are used is shown in FIG. 7. The connectors 2 are inserted into pockets 90 provided in a mounting block 92. As is shown in the figure, the connectors are terminated to the cables 4 prior to the connectors being inserted into the pockets. When the connectors are fully inserted into the pockets, the upper surface 60 of the guide block is provided in essentially the same plane as the upper surface 94 of the mounting block 92. The printed circuit board 6 is then brought into engagement with the portions of the board engagement sections 20 of the terminals 14 which extend beyond the guide block 10. This causes the board mounting sections 20 to resiliently compress, which in turn causes the board engagement sections 20 to provide a wiping action across the conductive areas of the printed circuit board. It should also be noted that as the sections 20 are compressed, lips 38 wipingly engage intermediate sections 18, thereby insuring that a positive electrical connection is effected therebetween. Mounting means maintain the board in engagement with the board engagement sections 20. This provides the cables 4 in electrical engagement with the printed circuit board 6.

Changes in construction will occur to those skilled in the art and various apparently different modifications and embodiments may be made without departing from the scope of the invention. The matter set forth in the foregoing description and accompanying drawings is offered by way of illustration only.

I claim:

1. An electrical terminal for electrically connecting conductors of a ribbon cable to respective conductive areas of a printed circuit board, the electrical terminal comprising:

an intermediate portion having a first end and a second end;

a cable mounting section extending from the first end of the intermediate portion, the cable mounting section having a slot provided therein, the slot cooperating with a respective conductor of the ribbon cable when the conductor is inserted into the slot, such that the slot removes the insulation of the conductor to place the conductor in electrical engagement with the terminal;

a board mounting section extending from the second end of the intermediate portion, the board mounting section having a board engagement area provided thereon, such that as the board is moved into engagement with the board engagement area, the resilient characteristics of the board mounting section will maintain the board engagement area in electrical engagement with the conductive areas of the printed circuit board.

2. An electrical terminal as recited in claim 1 wherein the width of the cable mounting section is greater than the width of the board mounting section, thereby enabling the electrical terminal to provide electrical connection between a ribbon cable and a printed circuit board in which the conductors and conductive areas do not have the same centerline spacing.

3. An electrical terminal as recited in claim 2 wherein a transition section is provided between the cable mounting section and the intermediate section, the transition section having shoulders stamped from each edge of the cable mounting section.

4. An electrical terminal as recited in claim 1 wherein the electrical terminal is stamped and formed from material having the required resilient and electrical characteristics.

5. An electrical terminal as recited in claim 1 wherein the board mounting section has an essentially oval-shaped configuration which is capable of a modicum of flattening, thereby giving the board mounting section the resilient characteristics required to insure that the board engagement area will be maintained in electrical engagement with the respective conductive areas of the printed circuit board.

6. An electrical terminal as recited in claim 3 wherein projections are provided proximate the shoulders of the terminal, the projections extending from side surfaces of the terminal.

7. An electrical connector for use to electrically connect conductors of ribbon cables to conductive areas of a printed circuit board, the electrical connector comprising:

a housing means having terminal receiving cavities extending therethrough;

terminals provided in the terminal receiving cavities, the terminals having cable termination sections provided at respective ends thereof and board termination sections provided at the opposite ends, the cable termination sections and the board termination sections having different centerline spacing;

transition sections provided on the terminals, the transition sections having shoulder means which cooperate with the housing means to maintain the terminals in position, and to distribute the forces associated with the terminals to the housing means.

8. An electrical connector as recited in claim 7 wherein the housing means has a housing block, a guide block, and a cover, each of which has latch means provided thereon to insure that each is accurately aligned with respect to the others.

9. An electrical connector as recited in claim 8 wherein the cover can be positioned in a first position in which the cover is spaced from the housing block, or in a second position in which the cover is provided proximate the housing block.

10. An electrical connector as recited in claim 8 wherein the the guide block has retention surfaces provided thereon, the retention surfaces cooperate with the shoulders of the terminals to maintain the terminal in position relative to the connector.

11. An electrical connector as recited in claim 7 wherein the terminals have intermediate portions which have first ends and second ends;

the cable termination sections extend from the first ends of the intermediate portions, the cable termination sections having slots provided therein, the slots cooperating with respective conductors of the ribbon cable when the conductors are inserted into the slots, such that the slots remove the insulation of the conductors to place the conductors in electrical engagement with the terminals;

board termination sections extend from second ends of the intermediate portions, the board termination sections have board engagement areas provided thereon, such that as the board is moved into engagement with the board engagement areas, the resilient characteristics of the board mounting sections will maintain the board engagement areas in electrical engagement with the conductive areas of the printed circuit board.

12. An electrical connector as recited in claim 11 wherein the width of the cable termination sections is greater than the width of the board termination sections, thereby enabling the electrical terminals to provide electrical connection between a ribbon cable and a printed circuit board in which the conductors and conductive areas do not have the same centerline spacing.

13. An electrical connector as recited in claim 11 wherein the board termination sections have essentially oval-shaped configurations which are capable of a modicum of flattening, thereby giving the board termination sections the resilient characteristics required to insure that the board engagement areas will be maintained in electrical engagement with the respective conductive areas of the printed circuit board.

14. An electrical terminal as recited in claim 11 wherein projections are provided proximate the shoulders of the terminals, the projections extending from side surfaces of the terminals.

* * * * *